United States Patent [19]

Schaub

[11] Patent Number: 4,787,199

[45] Date of Patent: Nov. 29, 1988

[54] YARN MONITORING DEVICE FOR A DOUBLING MACHINE

[75] Inventor: Hubert Schaub, Kempten, Fed. Rep. of Germany

[73] Assignee: Saurer-Allma GmbH, Kempten, Fed. Rep. of Germany

[21] Appl. No.: 107,374

[22] Filed: Oct. 9, 1987

[30] Foreign Application Priority Data

Nov. 3, 1986 [DE] Fed. Rep. of Germany ..... 8629229

[51] Int. Cl.[4] ..... D01H 13/16; D02H 13/04; D03D 51/18; D04B 35/10

[52] U.S. Cl. ..... 57/80; 28/186; 57/81; 57/87; 66/158; 139/336

[58] Field of Search ..... 57/78–87; 87/18, 19; 200/61.13, 61.18; 28/185–189; 66/158–164; 139/336, 349, 353, 354

[56] References Cited

U.S. PATENT DOCUMENTS

| | | | |
|---|---|---|---|
| 2,574,957 | 11/1951 | Bochmann et al. | 57/80 |
| 2,584,096 | 1/1952 | Thomas | 57/80 |
| 3,967,471 | 7/1976 | Matsumoto et al. | 66/161 |
| 4,091,604 | 5/1978 | Greive | 57/80 X |
| 4,506,498 | 3/1985 | Lamb | 57/87 |
| 4,676,056 | 6/1987 | Nickolay et al. | 57/81 |

*Primary Examiner*—John Petrakes

*Attorney, Agent, or Firm*—Flynn, Thiel, Boutell & Tanis

[57] ABSTRACT

A yarn monitoring device comprises in association with each doubling spindle (1) a sensing arm (7) monitoring the upwardly directed yarn run between yarn guide eye (3) and feed roller (V), which arm is mounted by means of a mounting bush (9) for limited swinging on a rocker shaft (6). The mounting bush (9) comprises a slot (12) extending in its circumferential direction, in which engages a stop pin (11) extending radial to the rocker shaft (6) and fixed relative thereto. In the slot (12) is a lining in the form of a substantially U-shaped clip (13) of spring steel, whose semi-circular connecting part (**13*b*) lies at the end surface (12*b*) of the slot (12) directed away from the spindle and whose U-arms (13*a*) extend parallel to the side walls (12*a*) of the slot (12), abut thereagainst and are inwardly bent at their free ends (13*c*) so that they grip on to the stop pin (11) in the swung up position of the sensing arm (7**).

5 Claims, 2 Drawing Sheets

YARN MONITORING DEVICE FOR A DOUBLING MACHINE

FIELD OF THE INVENTION

This invention relates to a yarn monitoring device for a doubling machine having associated with each doubling spindle a sensing arm monitoring the upwardly directed yarn run between yarn guide eye and feed roller, which arm is mounted by means of a mounting bush so that it can be swingable within limits on a rocker shaft extending over the whole machine length, wherein the mounting bush comprises a circumferentially extending slot, in which engages a stop pin extending radially to the rocker shaft and fixidly mounted relative to the rocker shaft.

BACKGROUND OF THE INVENTION

In one such known yarn monitoring device, a sensing part of the sensing arm extending horizontally in the longitudinal machine direction lies against the yarn section extending between the yarn guide eye and the feed roller, wherein further guide rollers can optionally be provided above the guide part and below the feed roller. If a yarn breakage occurs, the sensing part loses its support by the yarn and the sensing arm swings down until one end of the slot of the mounting bush comes into abutment against the stop pin. The sensing arm then assumes a substantially horizontal position, whereby a yarn clip comes into the region of rotation of the yarn section running from the supply spool to the upper end of the yarn guide tube of the doubling spindle. The rotating yarn section is caught by the clamp device and further yarn takeoff from the supply spool thereby interrupted. Moreover, a red signal plate is fixed on the free end of the sensing arm, which stands out beyond the longitudinal side of the machine, when the sensing arm has fallen into its horizontal position as a result of a yarn breakage.

The projecting red marker signals the yarn breakage to the operator. On dealing with the yarn breakage and on renewed operation of the spindle the sensing arm would be in the path. However it would interfere with the twisting while the spool yarn tension was not attained between the yarn guide eye and the feed roller. For this reason, each sensing arm can be individually swung up with respect to the rocker shaft and it can be held in this swung up position by a support arm of the yarn guide eye, in that this support arm is swung to the side out of its normal position. This holding for the sensing arm is satisfactory for threading the yarn into the twisting spindle and also for changing the supply spool. On twisting however, the thread guide eye must be swung back again into its normal position and then the sensing arm loses its support. So that the sensing arm shall not interfere with the further guiding of the thread and the twisting, while the full yarn tension has not been attained, it must initially be held manually. This is however disadvantageous since one has only one hand available for guiding the yarn. Furthermore, it has been found that severe wear occurs in the mounting bush of the sensing arm in the region of the slot. In fact the mounting bush consists of diecast aluminum because of its varying form, the stop pin however of steel. As a result of the unavoidable vibrations of the machine the stop pin works itself gradually into the material of the mounting bush.

This invention is based on the problem of providing a yarn monitoring device for a doubling machine of the kind initially mentioned, which is operator-friendly when threading and with which moreover the mentioned wear is avoided.

This is attained in accordance with the invention, in that a lining is arranged in the slot in the form of a substantially U-shaped clip of spring steel, whose semicircular connecting part joining the two U-arms lies at the end surface of the slot directed away from the spindle and whose U-arms extend parallel to the sidewalls of the slot, lie against these and are bent inwardly at their free ends so that the mutual spacing of the two U-arms is somewhat smaller at their free ends than the diameter of the stop pin, and in that the two free ends grip on to the step pin in the swung up position of the sensing arm.

The clip of spring steel arranged in the slot has two functions. In the swung up position of the sensing arm it serves to arrest the same. Consequently the sensing arm can be arrested in the swung up position independently of the support arm of the yarn guide eye. The yarn guide eye can consequently be swung into its central position above the spindle axis at the appropriate time when threading and the operator still has both hands free for further guiding of the yarn over the guide rollers and the feed roller to the winding up spool. This is particularly important with fine yarns. Only when the yarn is completely in position and also the full yarn tension is attained in the yarn section between yarn guide eye and feed roll, is the sensing arm pressed down against the holding force of the clip, until its sensing part lies against the yarn section between yarn guide eye and feed roller. Furthermore the clip serves as a lining for the bounding walls of the slot. Since the clip consists of spring steel, wear of the clip is not to be feared and wear of the mounting bush itself is avoided. Since the clip consists of spring steel it can be made relatively thin. This has the further advantage that the clip can even be retrofitted to existing yarn monitoring devices of the kind in question, in which wear has already appeared in the mounting bushes or further wear is to be avoided.

BRIEF DESCRIPTION OF THE DRAWINGS

The invention is explained in more detail below with reference to the embodiment shown in the drawings. These show.

DETAILED DESCRIPTION

Figure 1:
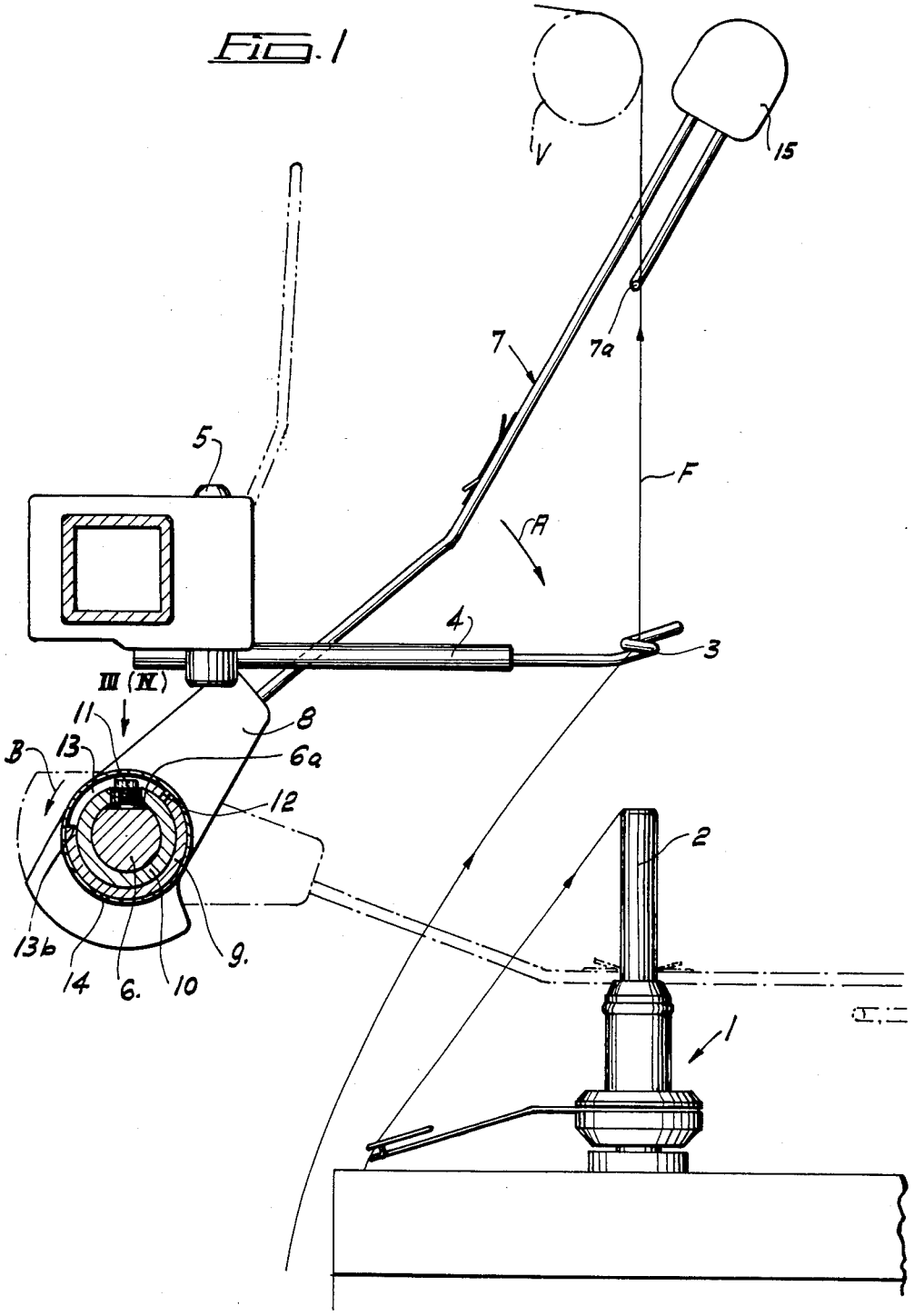
FIG. 1 a cross section of the yarn monitoring device in operating position.

In the drawing a doubling spindle is indicated at 1, which comprises a yarn guide tube 2 at its upper end in known manner. In prolongation of the spindle axis there is arranged a yarn guide eye 3, which is held in its operating position by the support of 4. The support arm 4 is swingable sideways out of the way about the pivot 5.

A rocker shaft 6 extends over the whole machine length in the machine longitudinal direction. Associated with each doubling spindle 1 is a sensing arm 7. The sensing arm is gripped in a holder part 8 which is unitarily formed with a mounting bush 9 and consists of die-cast aluminum. The mounting bush 9 is mounted pivotally on an intermediate bush 10 which is fixed on the rocker shaft 6 by means of a set screw 11 and a flat 6a. The set screw 11 projects radially beyond the outer periphery of the intermediate bush 10 and is received in a slot 12 extending in the circumferential direction of the mounting bush 9. In the slot 12 there is arranged a substantially U-shaped clip 13 which consists of spring steel, advantageously of leaf spring steel, with rectangular cross section. The spring clip 13 comprises two U-arms 13a which are connected by a semi-circular bent connecting piece 13b. The spring clip 13 iies with this connecting piece 13b against that end surface 12b of the slot which is directed away from the doubling spindle 1. Moreover the U-arms 13a extend parallel to the sidewall 12a of the slot 12 and lie against the side walls 12a. The clip 13 thus forms a liner for the slot 12. Moreover, the U-arms 13a are bent somewhat inwardly at their free ends 13c so that the mutual spacing a of the two U-arms 13a at their ends 13c is somewhat smaller than the diameter d of the set screw 11 serving as stop 10.

The two U-arms 13a of the clip 13 are moreover curved in their longitudinal direction in accordance with the radius of the mounting bush 9.

In order that no dirt, in particular no fluff, can get into the slot 12, the mounting bush 9 is surrounded by a protective sleeve 14. This protective sleeve 14 is axially displaceable on the mounting bush 9 and covers the slot 12 in normal position. By means of the protective sleeve 12, the clip 13 is additionally held in the slot 12.

OPERATION

Figure 3:
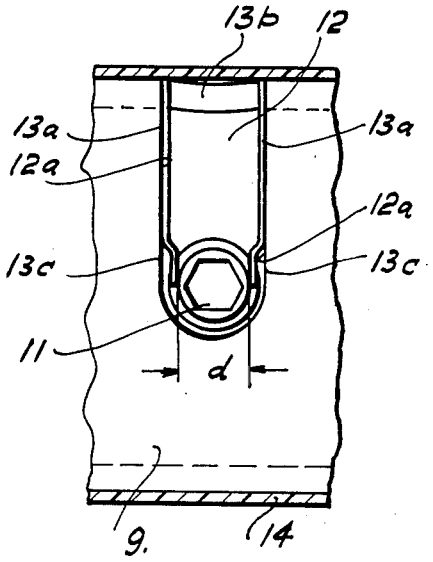
FIG. 3 a partial view in direction III of FIG. 1, however in the arresting positon of the sensing arm.
Figure 4:
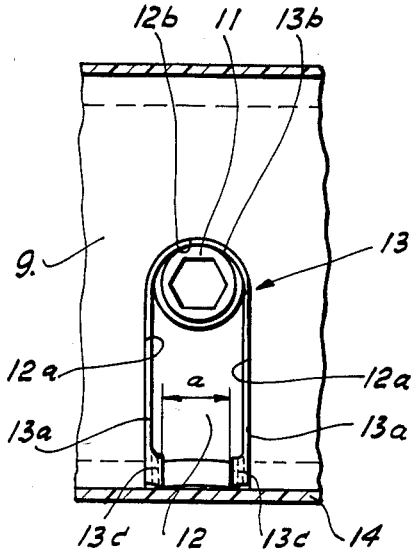
FIG. 4 a partial view in direction IV of FIG. 1, however in the position of the sensing arm with a yarn breakage.
Figure 2:
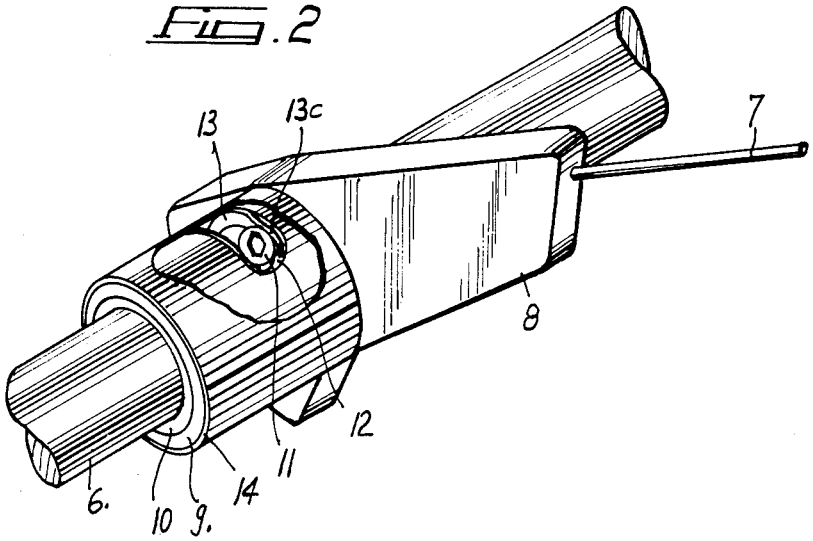
FIG. 2 a perspective representation of a part of the device in the arresting position of the sensing arm.

The operation of the yarn monitoring device is briefly explained in the following:

In the operating position represented in FIG. 1 the sensing arm 7 rests with its sensing part 7a, which extends essentially horizontal and in the machine longitudinal direction, against the tensioned part of the yarn F in the region between the yarn guide eye 3 and the feed roller V represented only diagramatically in chain dotted lines. Beneath the feed roller V there could also be arranged further guide rollers not shown. If the yarn F breaks in any place, then it loses its tension and the sensing part 7a is no longer supported. The sensing arm 7 swings down in the direction A into the position shown in chain dotted lines. The downwards swinging movement of the sensing arm 7 is stopped when the arcuate connecting piece 13b of the clip 13 comes into abutment with the set screw 11. The sensing arm 7 is provided with a red signal plate 15 at its free end, which projects somewhat beyond the longitudinal side of the machine on yarn breakage, in the chain dotted lower position, thereby signaling the yarn breakage to the operator. On dealing with the yarn breakage the sensing lever 7 is swung upwardly opposite to the arrow direction A, whereby the free ends 13c of the U-arms 13a grip on the set screw 11, as is shown in FIGS. 2 and 3. The sensing lever 7 is thereby arrested in the position which is indicated in FIG. 1 by chain double dotted lines. In this position it does not interfere with the threading in any way. Only when the threading is complete will the sensing lever 7 be swung downwardly from its arrest position into its operating position shown in full in FIG. 1, until its sensing part 7a abuts the tensioned yarn F.

Since on starting up the machine sufficient yarn tension is not available, it is advantageous, especially with fine yarns, if the sensing arm 7 does not lie with its sensing part 7a against the yarn F and does not interfere with the running of the yarn. In order to prevent engagement of the guide parts 7a of all of the sensing arms on starting the machine, the rocker arm 6 can be swung automatically in the direction B by the drive head of the machine. The stop pin 11 then comes into abutment against the connecting piece 13b and thereby swings the mounting bush 9 also in the direction B. The sensing part 7a of the sensing arm 7 thereby comes into a position which no longer interferes with the yarn run.

The U-arms 13a of the clip 13 are advantageously sprung apart in V- formation before fitting into the slot 12, so that the distance between their free ends 13c is greater than the width of the slot 13. When the clip 13 is fitted into the slot 12, then its arms 13a lie under tension against the side walls of the slot and the clip is held in this manner in the slot.

The embodiments of the invention in which an exclusive property or privilege is claimed are defined as follows:

1. In a yarn monitoring device for a doubling machine having a rocker shaft extending over the whole machine length, plural doubling spindles spaced along the length of said machine, means defining a yarn guide eye and a feed roller for each of said plural doubling spindles, each doubling spindle having associated therewith a sensing arm monitoring the upwardly directed yarn run between said yarn guide eye and said feed roller, which arm is mounted on said rocker arm by means of a mounting bush to facilitate a swinging of said arm within limits provided on said rocker shaft, a stop pin fixedly mounted on said rocker shaft and extending radially thereto, wherein said mounting bush comprises a circumferentially extending slot, in which is received said stop pin, the improvement wherein a lining member is arranged in said slot, said lining member being substantially U-shaped and made of spring steel, said lining member having a semi-circular connecting part joining two U-arms adjacent an end surface of said slot remote from said spindle, said U-arms extending parallel to the sidewalls of said slot and engaging said sidewalls, said U-arms additionally being bent inwardly at their free ends so that a spacing between said free ends is somewhat smaller than the diameter of said stop pin, and wherein said two free ends grip on to said stop pin in one position of said sensing arm.

2. The device according to claim 1, wherein said lining member consists of leaf spring steel.

3. The device according to claim 1, wherein said U-arms of the clip are curved in their longitudinal direction corresponding to the radius of said mounting bush.

4. The device according to claim 1, wherein said mounting bush is surrounded by a protective sleeve axially slideable thereon.

5. The device according to claim 1, wherein said U-arms of the clip are sprung apart in V-shaped before fitting into said slot, so that the distance between their free ends is greater than the breadth of said slot, whereby said U-arms abut under tension against said sidewalls after a fitting of said lining member into said slot.

* * * * *